US008401444B2

(12) United States Patent
Sugimura et al.

(10) Patent No.: US 8,401,444 B2
(45) Date of Patent: Mar. 19, 2013

(54) DEVELOPING ROLLER COMPRISING SURFACE LAYER CONTAINING WATER-DISPERSIBLE SILICA AND/OR AQUEOUS SILICONE ACRYLIC GRAFT POLYMER

(75) Inventors: Takayuki Sugimura, Yokohama (JP); Kota Kawano, Yokohama (JP); Hirotaka Tagawa, Yokohama (JP)

(73) Assignee: Bridgestone Corporation, Tokyo (JP)

( * ) Notice: Subject to any disclaimer, the term of this patent is extended or adjusted under 35 U.S.C. 154(b) by 378 days.

(21) Appl. No.: 12/669,162

(22) PCT Filed: Jul. 14, 2008

(86) PCT No.: PCT/JP2008/062681

§ 371 (c)(1),
(2), (4) Date: Jan. 14, 2010

(87) PCT Pub. No.: WO2009/011330

PCT Pub. Date: Jan. 22, 2009

(65) Prior Publication Data

US 2010/0189473 A1 Jul. 29, 2010

(30) Foreign Application Priority Data

Jul. 17, 2007 (JP) ..... 2007-186310

(51) Int. Cl.
*G03G 15/08* (2006.01)

(52) U.S. Cl. ..... 399/286; 399/265; 399/279

(58) Field of Classification Search ..... 399/265, 399/279, 286

See application file for complete search history.

(56) References Cited

U.S. PATENT DOCUMENTS

| | | | | |
|---|---|---|---|---|
| 2002/0031378 | A1* | 3/2002 | Arai et al. | 399/286 |
| 2003/0022775 | A1* | 1/2003 | Tsunemi et al. | 492/59 |
| 2004/0170449 | A1* | 9/2004 | Sakata et al. | 399/286 |
| 2007/0003331 | A1* | 1/2007 | Kawano et al. | 399/286 |
| 2007/0111874 | A1* | 5/2007 | Sugimura et al. | 492/59 |
| 2008/0292366 | A1* | 11/2008 | Akama et al. | 399/286 |

FOREIGN PATENT DOCUMENTS

| | | | |
|---|---|---|---|
| CN | 1794108 | A | 6/2006 |
| JP | 11-167271 | A | 6/1999 |
| JP | 11-212354 | A | 8/1999 |
| JP | 2003-167398 | A | 6/2003 |
| JP | 2004-037669 | A | 2/2004 |
| JP | 2004-198710 | A | 7/2004 |
| JP | 2005-077990 | A | 3/2005 |

(Continued)

OTHER PUBLICATIONS

Office Action issued Oct. 26, 2011 in Chinese Patent Application No. 200880024939.4.

*Primary Examiner* — Ryan Walsh
(74) *Attorney, Agent, or Firm* — Sughrue Mion, PLLC

(57) ABSTRACT

A developing roller which shows an excellent environmental performance and is free from occurrence of toner filming and toner leakage is provided. The developing roller 10 comprises a shaft 1, an elastic layer 2 supported on the outer periphery of the shaft 1, and a single surface layer 3 formed on the outer peripheral surface of the elastic layer 2. The elastic layer 2 comprises a polyurethane foam and the surface layer 3 comprises an aqueous polyurethane resin as a major component and further a water-dispersible silica and/or an aqueous silicone acrylic graft polymer. As the aqueous polyurethane resin, a UV curing resin may be preferably used.

8 Claims, 1 Drawing Sheet

FOREIGN PATENT DOCUMENTS

| | | | |
|---|---|---|---|
| JP | 2005-308838 | A | 11/2005 |
| JP | 2005-338167 | A | 12/2005 |
| JP | 2006-003758 | A | 1/2006 |
| JP | 2006-309128 | A | 11/2006 |
| JP | 2007-033843 | A | 2/2007 |
| JP | 2007-057559 | A | 3/2007 |
| WO | WO 2006001171 | A1 * | 1/2006 |

* cited by examiner

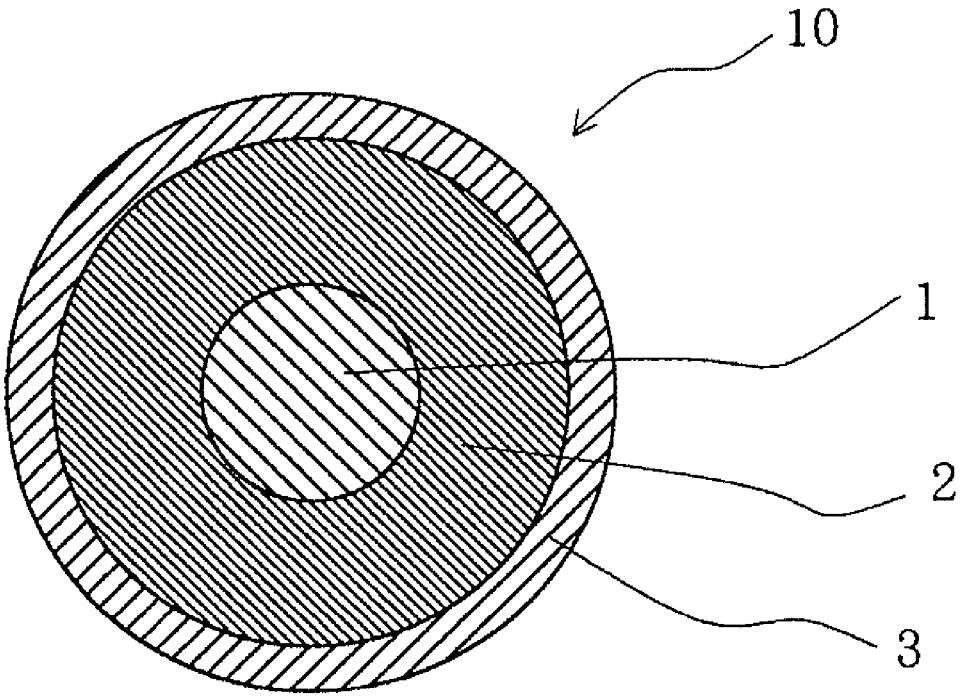
10
1
2
3

DEVELOPING ROLLER COMPRISING SURFACE LAYER CONTAINING WATER-DISPERSIBLE SILICA AND/OR AQUEOUS SILICONE ACRYLIC GRAFT POLYMER

TECHNICAL FIELD

The present invention relates to a developing roller (hereinafter also simply referred to as "roller"), more concretely, a developing roller used for image forming apparatuses such as electrophotographic devices including copiers and printers; and electrostatic recording apparatuses.

BACKGROUND ART

In image forming apparatuses using electrophotographic methods, such as copiers and printers, roller members given electric conductivity are used in electrophotographic processes such as development, charging and transfer (toner feeding and cleaning).

As the roller members used as developing rollers, charge rollers, transfer rollers (toner feeding and cleaning) and the like, ones provided with a basic structure having an elastic layer comprising a conductive rubber, polymeric elastomer, polymeric foam or the like given electric conductivity by blending a conductive agent therein, which elastic layer is formed on the outer periphery of the shaft; and further with a single or multiple coating layers on the outer periphery of the layer to attain a desired surface roughness, electric conductivity, hardness and the like; have been conventionally used.

For example, in cases where an elastic layer comprising a polyurethane foam is used, since the surface of the foam has open cells, there are problems such as melting of the surface of the elastic layer caused by a solvent-type paint, so that the surface roughness cannot be controlled. In cases where the surface roughness cannot be controlled, for example, in a developing roller, problems such as roughness of printed images and occurrence of toner filming are caused, so that a method wherein the surface roughness is adjusted by formation of a coating layer with an aqueous paint containing an aqueous resin has been conventionally used for an elastic layer comprising a polyurethane foam. Since coating layers by an aqueous paint have low impacts on the environment unlike solvent-type paints, they can be said to be excellent from the view point of environmental protection.

Examples of an improved technology for a roller member include one for a developing roller disclosed in Patent Document 1 which is constituted by an elastic layer and a single or multiple resin layer(s) laminated sequentially and concentrically on the periphery of a conductive shaft, wherein the major component of at least the surface layer among the resin layers is a polyurethane resin obtained by reacting a polyol, an isocyanate and, as required, a chain elongation agent, wherein one or both of the polyol and the chain elongation agent has/have a polysiloxane skeleton, and the document also discloses to make 100% modulus of the surface layer not less than $5\times10^6$ Pa and not more than $30\times10^6$ Pa. Further, in Patent Document 2, a conductive member for electrophotography is disclosed, which conductive member comprises in the outer periphery of the conductive support a conductive elastic material mainly constituted by a polymer having a halogen group, which conductive elastic material contains an inorganic compound containing a metallic element whose chloride has a solubility of not more than 30 g, which inorganic compound was hydrophobized, wherein the outermost layer of the conductive elastic material is more highly cross-linked than the inside thereof.

Patent Document 1: Japanese Unexamined Patent Application Publication No. 11-212354 (Claims and the like)

Patent Document 2: Japanese Unexamined Patent Application Publication No. 2005-338167 (Claims and the like)

DISCLOSURE OF THE INVENTION

Problems to be Solved by the Invention

As described above, in a roller having an elastic layer comprising a polyurethane foam, control of the surface roughness is possible by providing on the surface a coating layer comprising an aqueous paint. However, without taking the elongation and the elastic modulus of the coating layer into consideration, during the sliding contact with a photosensitive drum or the like, the roller surface may not be able to follow the photosensitive drum, causing problems such as toner filming and toner leakage.

Thus, an object of the present invention is to solve the above-described problems and to provide a technology by which toner filming and toner leakage can be prevented in a developing roller in which an aqueous paint having a low impact on the environment is used.

Means for Solving the Problems

The present inventors intensively studied to discover that the above problems can be solved by addition of a water-dispersible silica and/or an aqueous silicone acrylic graft polymer to a coating layer using an aqueous resin, thereby completing the present invention.

That is, the developing roller of the present invention comprises a shaft, an elastic layer supported on the outer periphery of the shaft, and a single surface layer formed on the outer peripheral surface of the elastic layer, wherein the elastic layer comprises a polyurethane foam and the surface layer comprises an aqueous polyurethane resin as a major component and further a water-dispersible silica and/or an aqueous silicone acrylic graft polymer.

In the present invention, a UV curing resin is preferably used as the aqueous polyurethane resin, and the polyurethane foam is preferably formed by mechanical frothing. Further, preferably, the content of the water-dispersible silica is within the range of 0.2 to 30 parts by weight with respect to 100 parts by weight of the solid content of the aqueous polyurethane resin, and the content of the aqueous silicone acrylic graft polymer is within the range of 0.2 to 30 parts by weight with respect to 100 parts by weight of the solid content of the aqueous polyurethane resin. Further, in the roller of the present invention, the elongation of the surface layer is preferably within the range of 50 to 400%, and the storage modulus of the surface layer at a frequency of 11 Hz is preferably within the range of 8 to 20 MPa.

Effect of the Invention

According to the present invention, by employing the above constitution, a developing roller which is excellent from the view point of environmental protection and free from occurrence of toner filming and toner leakage can be attained.

BRIEF DESCRIPTION OF THE DRAWINGS

FIG. 1 is a schematic perspective view showing an example of the constitution of the developing roller of the present invention.

DESCRIPTION OF SYMBOLS

1 shaft
2 elastic layer
3 surface layer
10 developing roller

BEST MODE FOR CARRYING OUT THE INVENTION

Preferred modes of the present invention will be described in detail below.

FIG. 1 shows a schematic perspective view showing an example of the constitution of the developing roller of the present invention. As shown in the drawing, the developing roller 10 of the present invention comprises a shaft 1, an elastic layer 2 supported on its outer periphery, and a single surface layer 3 formed on the outer peripheral surface of the elastic layer 2.

In the present invention, the elastic layer 2 comprises a polyurethane foam and the surface layer 3 comprises as a major component an aqueous polyurethane resin and further a water-dispersible silica and/or an aqueous silicone acrylic graft polymer. Since the surface layer 3 is formed on the elastic layer 2 such that it contains as a major component an aqueous polyurethane resin, a solvent is not required to be used, so that the impact on the environment can be reduced; and by addition of at least one of the water-dispersible silica and aqueous silicone acrylic graft polymer, a desired surface layer elongation can be obtained and the followability to a photosensitive drum or the like is improved, thereby solving problems such as toner filming and toner leakage.

In the present invention, any one or both of a water-dispersible silica and an aqueous silicone acrylic graft polymer may be added to the surface layer 3, and an effect to prevent occurrence of toner filming and toner leakage can be obtained in either case. Especially, in cases where a water-dispersible silica is added, the hydrophilic silica exerts a moisture absorption effect within the surface layer, so that the surface properties of the aqueous surface layer can be advantageously assured even at high humidity.

Further, in terms of the amount(s) of the water-dispersible silica and/or the aqueous silicone acrylic graft polymer to be added to the surface layer 3, the amount of water-dispersible silica is preferably within the range of 0.2 to 30 parts by weight, especially within the range of 5 to 20 parts by weight with respect to 100 parts by weight of the solid content of the aqueous polyurethane resin, and the amount of the aqueous silicone acrylic graft polymer is also preferably within the range of 0.2 to 30 parts by weight, especially within the range of 5 to 20 parts by weight with respect to 100 parts by weight of the solid content of the aqueous polyurethane resin. In cases where the amount of the water-dispersible silica or the aqueous silicone acrylic graft polymer to be added is smaller than the above ranges, toner filming and toner leakage may not be prevented sufficiently, and in cases where the amount is larger than the above ranges, the dispersibility with the aqueous polyurethane resin may be inadequate.

The aqueous polyurethane resin used for the surface layer 3 may be either thermosetting type or UV curing type, and a UV curing resin which cures quickly is especially preferably used. In the present invention, since both of the water-dispersible silica and the aqueous silicone acrylic graft polymer to be contained in the surface layer 3 have good light transmittances, they can be said to have good compatibilities with a UV curing resin. In terms of the condition for the UV curing, the accumulated light intensity of UV irradiation may be for example 50 to 2000 mJ/cm$^2$, and in cases where the amount of the irradiation is smaller than this range, the surface layer 3 may not be sufficiently cured, and in cases where the amount of the irradiation is larger than this range, the surface layer 3 may be burned, which are impractical.

In the present invention, by using the above-described aqueous polyurethane resin and the water-dispersible silica and/or the aqueous silicone acrylic graft polymer, it is possible to obtain a flexible surface layer whose elongation is within the range of preferably 50 to 400%, more preferably 100 to 300%, and whose storage modulus at a frequency of 11 Hz is within the range of preferably 8 to 20 MPa, more preferably 10 to 20 MPa. The thickness of the surface layer 3 is not particularly limited, and preferably within the range of 10 to 50 μm.

The raw material of the polyurethane foam constituting the elastic layer 2 of the present invention is not particularly limited as long as it contains urethane bond in the resin. Examples of the polyol component which may be used include polyether polyols produced by addition polymerization of ethylene oxide and propylene oxide; polytetramethylene ether glycols; polyester polyols produced by condensation of an acid component and a glycol component; polyester polyols produced by ring-opening polymerization of caprolactone; and polycarbonate diols.

Examples of the polyether polyol produced by addition polymerization of ethylene oxide and propylene oxide include those produced by addition polymerization of ethylene oxide and propylene oxide using as the starting material water, propylene glycol, ethylene glycol, glycerin, trimethylolpropane, hexanetriol, triethanolamine, diglycerine, pentaerythritol, ethylenediamine, methylglucosite, aromatic diamine, sorbitol, sucrose, phosphate or the like, and those using as the starting material water, propylene glycol, ethylene glycol, glycerin, trimethylolpropane or hexanetriol are especially preferred. In terms of the ratios and microstructures of ethylene oxide and propylene oxide to be added, the ratio of ethylene oxide is preferably 2 to 95% by weight, more preferably 5 to 90% by weight, and ethylene oxide is preferably added to the ends. Further, the sequence of ethylene oxide and propylene oxide in the molecular chain is preferably random.

Such a polyether polyol is bifunctional in cases where water, propylene glycol or ethylene glycol is used as the starting material, and its weight average molecular weight is preferably within the range of 300 to 6000, more preferably within the range of 400 to 3000. Further, it is trifunctional in cases where glycerin, trimethylolpropane or hexanetriol is used as the starting material, and its weight average molecular weight is preferably within the range of 900 to 9000, more preferably within the range of 1500 to 6000. Further, a bifunctional polyol and a trifunctional polyol may be used after being blended together as appropriate.

The polytetramethylene ether glycol can be obtained by, for example, cationic polymerization of tetrahydrofuran, and those having the weight average molecular weight within the range of 400 to 4000, especially within the range of 650 to 3000 are preferably used. Further, it is also preferred to blend polytetramethylene ether glycols having different, molecular weights together. Further, a polytetramethylene ether glycol obtained by copolymerization of alkylene oxides such as ethylene oxide and propylene oxide may also be used.

It is also preferred to use a polytetramethylene ether glycol and a polyether polyol produced by addition polymerization of ethylene oxide and propylene oxide, after blending thereof together. In this case, they are preferably blended at a weight ratio within the range of 95:5 to 20:80, especially within the range of 90:10 to 50:50.

Further, in combination with the above-described polyol component, a polymer polyol produced by acrylonitrile modification of a polyol, a polyol produced by addition of melamine to a polyol, a diol such as butane diol, a polyol such as trimethylolpropane, or a derivative thereof may also be used.

Examples of the isocyanate which is preferably used for constituting the polyurethane foam include aromatic isocyanates and derivatives thereof, aliphatic isocyanates and derivatives thereof, and alicyclic isocyanates and derivatives thereof. Among these, aromatic isocyanates and derivatives thereof are preferred, and tolylene diisocyanate (TDI) and a derivative thereof, and diphenylmethane diisocyanate (MDI) and a derivative thereof are especially preferably used.

Examples of the tolylene diisocyanate or a derivative thereof which may be used include crude tolylene diisocyanate; 2,4-tolylene diisocyanate; 2,6-tolylene diisocyanate; mixtures of 2,4-tolylene diisocyanate and 2,6-tolylene diisocyanate; their urea-modified products, biuret-modified products and carbodiimide-modified products, and urethane-modified products produced by modification with polyols or the like. Examples of the diphenylmethane diisocyanate or a derivative thereof include diphenylmethane diisocyanates and derivatives thereof obtained by phosgenation of diaminodiphenylmethane or a derivative thereof. Examples of the derivative of the diaminodiphenylmethane include those which are polynuclear, and pure diphenylmethane diisocyanate obtained from diaminodiphenylmethane and polymeric diphenylmethane diisocyanates obtained from polynuclear of diaminodiphenylmethanes may be used. In terms of the number of functional groups of the polymeric diphenylmethane diisocyanate, a mixture of pure diphenylmethane diisocyanate and polymeric diphenylmethane diisocyanates having various numbers of functional groups is usually used, and those having the average numbers of functional groups of preferably 2.05 to 4.00, more preferably 2.50 to 3.50, are used. Further, derivatives obtained by modification of these diphenylmethane diisocyanates or derivatives thereof, for example, urethane-modified products modified with polyols or the like, dimers produced by uretidione formation, isocyanurate-modified products, carbodiimide/uretonimine-modified products, allophanate-modified products, urea-modified products and biuret-modified products may also be used. Further, several types of diphenylmethane diisocyanates and derivatives thereof may be used after being blended together.

Further, the isocyanate may be prepolymerized in advance with a polyol, and examples of its method include a method wherein a polyol and an isocyanate are placed in an appropriate container, and the mixture is stirred sufficiently, followed by incubation thereof at 30 to 90° C., more preferably at 40 to 70° C., for 6 to 240 hours, more preferably for 24 to 72 hours. In this case, the ratio of the amounts of the polyol and the isocyanate is adjusted such that the content of the isocyanate in the obtained prepolymer becomes preferably 4 to 30% by weight, more preferably 6 to 15% by weight. In cases where the content of the isocyanate is less than 4% by weight, the stability of the prepolymer is deteriorated and the prepolymer is cured during storage, so that the prepolymer may not be usable. In cases where the content of the isocyanate is higher than 30% by weight, the content of the isocyanate which is not prepolymerized increases, and this polyisocyanate is cured with a polyol component used in the later polyurethane curing reaction by a reaction mechanism similar to the one-shot method wherein a prepolymerization reaction is not involved, so that the effect by using the prepolymer method decreases. In cases where the isocyanate component to be used is prepared by prepolymerization in advance of isocyanate with a polyol, examples of the polyol component which may be used include, in addition to the above-described polyol components, diols such as ethylene glycol and butanediol, polyols such as trimethylolpropane and sorbitol, and derivatives thereof.

In addition to these polyol components and isocyanate components, conductive agents, foaming agents (water, low-boiling materials, gaseous materials and the like), cross-linking agents, surfactants, catalysts, foam stabilizers and the like may be added to the raw material of the polyurethane foam, to prepare a desired elastic layer.

The conductive agent may be an ion conductive agent or an electron conductive agent, and examples of the ion conductive agent include ammonium salts of perchlorates, chlorates, hydrochlorides, bromates, iodates, hydrofluoroborates, sulfates, alkyl sulfates, carboxylates, sulfonates and the like, such as tetraethylammonium, tetrabutylammonium, dodecyltrimethylammonium (lauryltrimethylammonium, for example), hexadecyltrimethylammonium, octadecyltrimethylammonium (stearyltrimethylammonium, for example), benzyltrimethylammonium and modified fatty acid dimethylethylammonium; and perchlorates, chlorates, hydrochlorides, bromates, iodates, hydrofluoroborates, trifluoromethylsulfates, sulfonates and the like of alkaline metals and alkaline earth metals such as lithium, sodium, potassium, calcium, magnesium and the like. Further, examples of the electron conductive agent include conductive carbons such as Ketjen Black and acetylene black; carbons for rubbers such as SAF, ISAF, HAF, FEF, GPF, SRF, FT and MT; carbons for inks subjected to oxidation treatment, pyrolytic carbons, natural graphites and artificial graphites; conductive metal oxides such as tin oxide, titanium oxide and zinc oxide; metals such as nickel, copper, silver and germanium. These conductive agents may be used individually or as a mixture of 2 or more types thereof. The content of the conductive agent is not particularly limited and may be appropriately selected as desired, and it is usually at a ratio of 0.1 to 40 parts by weight, preferably 0.3 to 20 parts by weight, with respect to 100 parts by weight of the total amount of the polyol and the isocyanate.

Examples of the catalyst used for the curing reaction of the polyurethane foam include monoamines such as triethylamine and dimethylcyclohexylamine; diamines such as tetramethylethylenediamine, tetramethylpropanediamine and tetramethylhexanediamine; triamines such as pentamethyldiethylenetriamine, pentamethyldipropylenetriamine and tetramethylguanidine; cyclic amines such as triethylenediamine, dimethylpiperazine, methylethylpiperazine, methylmorpholine, dimethylaminoethylmorpholine and dimethylimidazole; alcohol amines such as dimethylaminoethanol, dimethylaminoethoxyethanol, trimethylaminoethylethanolamine, methylhydroxyethylpiperazine and hydroxyethylmorpholine; ether amines such as bis (dimethylaminoethyl)ether and ethylene glycol bis (dimethyl)aminopropyl ether; organic metal compounds such as stannous octoate, dibutyltin diacetate, dibutyltin dilaurate, dibutyltin mercaptide, dibutyltin thiocarboxylate, dibutyltin dimaleate, dioctyltin mercaptide, dioctyltin thiocarboxylate, phenylmercuric propionate and lead octenoate. These catalysts may be used individually or 2 or more types thereof may be used in combination.

In the present invention, a silicone foam stabilizer and various types of surfactants are preferably mixed in the polyurethane foam mixture in order to stabilize cells of the foam material. Examples of the silicone foam stabilizer which are preferably used include dimethylpolysiloxane-polyoxyalkylene copolymers, and those comprising the dimethylpolysiloxane moiety having a molecular weight of 350 to 15000 and the polyoxyalkylene moiety having a molecular weight of 200 to 4000 are especially preferred. The molecular structure of the polyoxyalkylene moiety is preferably an addition polymer of ethylene oxide or an addition copolymer of ethylene oxide and propylene oxide, and its molecular ends are also preferably ethylene oxide. Examples of the surfactant include ionic surfactants such as cationic surfactants, anionic surfactants and ampholytic surfactants; and nonionic surfactants such as various types of polyethers and various types of polyesters. These may be used individually or 2 or more types thereof may be used in combination. The content of the silicone foam stabilizer and the various types of surfactants is preferably 0.1 to 10 parts by weight, more preferably 0.5 to 5 parts by weight, with respect to 100 parts by weight of the total amount of the polyol component and the isocyanate component.

As the method for foaming of the raw material of the polyurethane foam of the present invention, methods such as mechanical frothing, water frothing and foaming agent-frothing, which have been conventionally used, may be used, and especially, mechanical frothing by mechanical stirring while mixing an inert gas in the raw material is preferably used. Usage of mechanical frothing is advantageous since a skin layer can be easily formed on the surface of the polyurethane foam, and combination of the skin layer with the surface layer 2 of the present invention comprising an aqueous resin allows prevention of destruction of the skin layer which is easily attacked in a solvent system. Here, the inert gas used in the mechanical frothing may be a gas which is inert in the polyurethane reaction, and examples thereof include inert gases in the narrow sense such as helium, argon, xenon, radon and krypton; and gases which are not reactive with the raw material of the polyurethane foam, such as nitrogen, carbon dioxide and dry air.

In the present invention, when the elastic layer 2 is formed, a method for metal molding wherein the raw material of the polyurethane foam foamed as described above is casted in a metal mold or the like in which a shaft is placed, followed by curing of the material, can be preferably used, and by this, a polyurethane foam wherein a self skin layer (thin coating layer) is formed on the part contacting with the metal mold can be obtained. In this case, a mold-releasing property can be given to the metal mold by a method such as coating of the inner surface of the metal mold with a fluorine resin or the like. After demolding from the mold, the molded polyurethane foam can be subjected to a coating step with a paint for the surface layer without a polishing step. In the coating step, coating with the paint for the surface layer is carried out using a known method such as dip coating, spray coating or roll coater coating, and the paint is then dried, followed by heat curing thereof as desired to obtain the conductive roller of the present invention.

The shaft 1 of the developing roller 10 of the present invention is not particularly limited and an arbitrary shaft may be used as long as it has a good electric conductivity, and examples thereof which may be used include those wherein a steel material such as a sulfur free-cutting steel is coated with nickel, zinc or the like; cored bars constituted by a solid body made of a metal such as iron, stainless steel or aluminum; and metal shafts such as a metal cylindrical body whose inside is hollowed.

EXAMPLES

The present invention will be described more concretely by way of Examples below.

As illustrated in FIG. 1, the shaft 1; and the developing roller 10 having the elastic layer 2 and the surface layer 3 formed sequentially on the outer periphery of the shaft 1; were prepared according to the contents and numbers of parts shown in each of Tables 1 and 2 and to the procedure below.

First, into a cylindrical mold (manufactured by SUS, 12 mm inner diameter ϕ×290 mm length (length of the elastic layer-forming part: 225 mm)), an iron shaft (6 mm diameter p, 250 mm length) as the shaft 1 was inserted, and the shaft 1 was fixed with the upper and lower molds.

To 100 parts by weight of urethane-modified isocyanate having an NCO content of 6%, 2 parts by weight of carbon black (DENKA BLACK, manufactured by DENKI KAGAKU KOGYO K. K.) was mixed to obtain the isocyanate component; and 20 parts by weight of a polyetherpolyol (SANNIX HL332, manufactured by Sanyo Chemical Industries, Ltd.), 20 parts by weight of a polyesterpolyol (KURARAY Polyol F510, manufactured by KURARAY CO., LTD.), 5 parts by weight of a polydimethylsiloxane-polyoxyethylene copolymer (SF2937F, manufactured by Dow Corning Toray Silicone Co., Ltd.) and 0.02 parts by weight of dibutyltin dilaurate were blended to obtain the polyol component. These isocyanate component and the polyol component were mixed together, and dry air was mixed and dispersed therein by mechanical frothing to prepare a liquid raw material of the polyurethane foam, which was then poured into the above-described cylindrical mold whose temperature was adjusted to 25° C. from the gate inlet of the upper mold. This mold was heated in a furnace at 110° C. for 1 hour to carry out heat curing, and the mold was then cooled to carry out demolding, to make the outer periphery of the shaft 1 support the elastic layer 2 comprising the polyurethane foam.

Subsequently, the outer periphery of the elastic layer 2 was dip-coated with the paint blended for the surface layer as shown in Table 1 below and air-dried, followed by curing of the paint by UV irradiation at an accumulated light intensity of 1000 mJ/cm$^2$ using a UV lamp, thereby forming the surface layer 3 having a layer thickness of about 10 μm to prepare the developing roller 10.

<Evaluation of Imaging Properties>

Using each developing roller obtained as described above, evaluation of the imaging properties was carried out as follows.

(1) Evaluation of Images

Each obtained developing roller was incorporated in a cartridge, and continuous printing was carried out at 23° C. and 50% RH using HL-2040 manufactured by Brother Industries, Ltd. at a coverage rate of 1%. Solid images and halftone images at the beginning and ending of the tolerance test (printing of 5000 sheets) were subjected to visual evaluation based on the criteria below.

©: no unevenness in density

○: slight unevenness in density x: unevenness in density (2) Toner Filming Resistance A toner was sprinkled over the surface of each developing roller and the roller was incorporated in a cartridge, which was then left to stand at 50° C. for 1 week, followed by printing. The results are evaluated based on the criteria below.

○: Adhesion of the toner on the surface of the developing roller was not observed from the first sheet.

Δ: Adhesion of the toner on the surface of the developing roller was not observed until the 10th sheet was printed.

x: Adhesion of the toner on the surface of the developing roller was observed even after printing of more than 10 sheets.

(3) Evaluation of Toner Leakage

Whether or not there is leakage of the toner from the cartridge during the continuous printing was confirmed by visual observation.

<Evaluation of Coating Properties>

After film formation of each paint blended for the surface layer by casting method, UV irradiation was carried out at an accumulated light intensity of 1000 mJ/cm$^2$ using a UV lamp to prepare each of the coating samples having the sizes described below.

(1) Measurement of Elongation

To measure the elongation, a compact bench-top tester EZ-TEST manufactured by Shimadzu Corporation was used. The above-described coating sample was cut to a size of 10 mm width×50 mm length×500 μm thickness to provide a sample for the measurement, and the measurement was carried out at a chuck distance of 30 mm and a test speed of 30 mm/minute to obtain the elongation as the value of the deformation at break.

(2) Measurement of Elastic Modulus

To measure the elastic modulus, Rheovibron DDV manufactured by A&D Company, Limited was used. The above-described coating sample was cut to a size of 5 mm width×40 mm length×500 μm thickness to provide a sample for the measurement, and the measurement was carried out at a chuck distance of 30 mm by a pulling method, to obtain the elastic modulus as the value of the storage modulus at a frequency of 11 Hz.

The results obtained by the above-described evaluation are shown in Tables 1 and 2 below together with the values of the roller resistance and the surface roughness.

TABLE 1

| | | | Example 1 | Example 2 | Example 3 | Example 4 |
|---|---|---|---|---|---|---|
| Surface layer composition (parts by weight) | Aqueous resins | *1 | 90 | 80 | 70 | 80 |
| | | *2 | 10 | 10 | 20 | 10 |
| | | *3 | 0 | 10 | 10 | 10 |
| | Additives | *4 | 0.2 | 5 | 10 | 5 |
| | | *5 | 0.2 | 5 | 5 | 10 |
| | | *6 | 10 | 10 | 10 | 10 |
| | | *7 | 3 | 3 | 3 | 3 |
| Coating properties | Elongation (%) | | 312 | 289 | 177 | 189 |
| | Elastic modulus (MPa) | | 9 | 14 | 15 | 15 |
| Roller properties | Resistance (Ω/100 V) | | 6.2E+07 | 5.4E+07 | 5.9E+07 | 7.8E+07 |
| | Surface roughness (Rz) | | 5.6 | 4.9 | 4.8 | 5.2 |
| Imaging properties | Image before tolerance test | | ○ | ○ | ○ | ○ |
| | Image after tolerance test | | ○ | ○ | ○ | ○ |
| | Toner filming resistance | | ○ | ○ | ○ | ○ |
| | Toner leakage | | No | No | No | No |

*1) polyester urethane acrylate: R5002 (DAI-ICHI KOGYO SEIYAKU CO., LTD.)
*2) EO-modified bisphenol A diacrylate: BPE-4 (DAI-ICHI KOGYO SEIYAKU CO., LTD.)
*3) EO-modified trimethylolpropane triacrylate: TMP-3 (DAI-ICHI KOGYO SEIYAKU CO., LTD.)
*4) water-dispersible silica: STN-3 (Kitamura Chemicals Co., Ltd.)
*5) aqueous silicone graft acrylic polymer: Symac US-450 (Toagosei Co., Ltd.)
*6) urethane particles (10 μm average diameter): Art Pearl C800 (Negami Chemical Industrial Co., Ltd.)
*7) photoinitiator: DAROCUR 1173 (Ciba Specialty Chemicals Inc.)

TABLE 2

| | | | Example 5 | Example 6 | Comparative Example 1 | Comparative Example 2 |
|---|---|---|---|---|---|---|
| Surface layer composition (parts by weight) | Aqueous resins | *1 | 70 | 100 | 100 | 80 |
| | | *2 | 20 | 0 | 0 | 10 |
| | | *3 | 10 | 0 | 0 | 10 |
| | Additives | *4 | 10 | 30 | 0 | 0 |
| | | *5 | 10 | 30 | 0 | 0 |
| | | *6 | 10 | 10 | 10 | 10 |
| | | *7 | 3 | 3 | 3 | 3 |
| Coating properties | Elongation (%) | | 130 | 62 | 405 | 302 |
| | Elastic modulus (MPa) | | 16 | 18 | 9 | 12 |
| Roller properties | Resistance (Ω/100 V) | | 8.2E+07 | 7.9E+07 | 6.5E+07 | 8.2E+07 |
| | Surface roughness (Rz) | | 5.1 | 4.9 | 5.2 | 5.5 |
| Imaging properties | Image before tolerance test | | ○ | ○ | ○ | ○ |

TABLE 2-continued

| | Example 5 | Example 6 | Comparative Example 1 | Comparative Example 2 |
|---|---|---|---|---|
| Image after tolerance test | ○ | ○ | X | X |
| Toner filming resistance | ○ | ○ | X | X |
| Toner leakage | No | No | Peeled off at 1k | Peeled off at 2k |

As shown in the above Tables 1 and 2, in the developing roller in each Example wherein the surface layer comprising an aqueous polyurethane resin as a major component and further a water-dispersible silica and/or an aqueous silicone acrylic graft polymer was provided on the elastic layer comprising a polyurethane foam, it was confirmed that an appropriate elongation and elastic modulus could be obtained in the surface layer, so that toner filming and toner leakage did not occur and a good imaging performance was obtained and, at the same time, an excellent environmental performance could be attained. On the other hand, in Comparative Examples 1 and 2 wherein the water-dispersible silica and the aqueous silicone acrylic graft polymer were both not blended, toner filming occurred and, since the surface of the surface layer showed tackiness (stickiness), the adhesive strength between the surface layer and the photo conductor was high, so that the surface layer was peeled off from the elastic layer after printing 1000 sheets and 2000 sheets, respectively, causing toner leakage from edges.

The invention claimed is:

1. A developing roller comprising a shaft, an elastic layer supported on the outer periphery of said shaft, and a single surface layer formed on the outer peripheral surface of said elastic layer, wherein said elastic layer comprises a polyurethane foam and said surface layer comprises an aqueous polyurethane resin as a major component and further a water-dispersible silica and/or an aqueous silicone acrylic graft polymer.

2. The developing roller according to claim 1, wherein said aqueous polyurethane resin is a UV curing resin.

3. The developing roller according to claim 1, wherein said polyurethane foam is formed by mechanical frothing.

4. The developing roller according to claim 1, wherein said surface layer comprises said water-dispersible silica and the content of said water-dispersible silica is within the range of 0.2 to 30 parts by weight with respect to 100 parts by weight of the solid content of said aqueous polyurethane resin.

5. The developing roller according to claim 1, wherein said surface layer comprises said aqueous silicone acrylic graft polymer and the content of said aqueous silicone acrylic graft polymer is within the range of 0.2 to 30 parts by weight with respect to 100 parts by weight of the solid content of said aqueous polyurethane resin.

6. The developing roller according to claim 1, wherein an elongation of said surface layer is within the range of 50 to 289%.

7. The developing roller according to claim 1, wherein the storage modulus of said surface layer at a frequency of 11 Hz is within the range of 8 to 16 MPa.

8. The developing roller according to claim 1, wherein the storage modulus of said surface layer at a frequency of 11 Hz measured by Rheovibron DDV is within the range of 8 to 16 MPa.

* * * * *